United States Patent [19]

Stedman

[11] 4,059,172

[45] Nov. 22, 1977

[54] LIFT TRUCK MAST POSITIONING MECHANISM

[75] Inventor: Robert N. Stedman, Chillicothe, Ill.

[73] Assignee: Caterpillar Tractor Co., Peoria, Ill.

[21] Appl. No.: 705,846

[22] Filed: July 16, 1976

[51] Int. Cl.[2] ..... B66F 9/06

[52] U.S. Cl. ..... 187/9 E

[58] Field of Search ..... 187/9 R, 9 E; 214/660, 214/670–674

[56] References Cited

U.S. PATENT DOCUMENTS

| | | | |
|---|---|---|---|
| 3,782,502 | 1/1974 | Kobayashi et al. | 187/9 E |

FOREIGN PATENT DOCUMENTS

| | | | |
|---|---|---|---|
| 1,203,701 | 1/1960 | France | 214/671 |
| 1,256,406 | 2/1961 | France | 187/9 R |
| 99,672 | 8/1964 | Denmark | 214/672 |
| 821,383 | 10/1959 | United Kingdom | 214/672 |
| 837,344 | 6/1960 | United Kingdom | 214/671 |

*Primary Examiner*—Johnny D. Cherry
*Assistant Examiner*—Jeffrey V. Nase
*Attorney, Agent, or Firm*—John W. Grant

[57] ABSTRACT

An upwardly extending mast is disposed adjacent a forward end of a lift truck main frame which has a mounting tower secured to and extending upwardly therefrom. A pair of longitudinally extending vertically spaced parallel arms have their forward ends pivotally connected to the mast and their rearward ends individually pivotally connected to a pair of sector gear devices rotatably mounted on the mounting tower in spaced relation to one another. A gear device is rotatably mounted to the tower in meshing engagement with both of the sector gear devices and includes a crank arm which extends therefrom and has its distal end pivotally connected to one end of a guide link which has its other end pivotally connected to one of the pair of arms. A motor device is provided for raising the mast relative to the main frame.

12 Claims, 4 Drawing Figures

3Д
36
37
19
33
32
31
11
18
14
16
22
39
Д1
Д2
52
10
Д3
ДД
Д6
Д7
Д8
Д9
59
60
51
61
53
54
57
17
30
13
56
58
62
12
63
21

37
22
16
3Д
14
19
18
31
17
30
Д1
39
38
Д2
51
52
58
53
10
Д3
ДД
Д6
Д9
57
56
54
62
21

LIFT TRUCK MAST POSITIONING MECHANISM

BACKGROUND OF THE INVENTION

This invention relates to a lift truck and more particularly to the mast positioning mechanism for mounting the mast to the lift truck and controlling its position relative thereto.

Fork lift trucks are widely used in many industries for stacking operations wherein material is stacked in vertical tiers. To conserve floor space, the distance between the vertical tiers is minimal and the lift trucks are generally designed with a short wheel base for maneuverability in such cramped quarters. Thus, the load carrying capacity is governed partially by the distance that the forks extend ahead of the front wheels. For this reason, the placement of the forks and the mast relative to the front wheels throughout their working lift height is an important consideration in all lift truck designs.

Several load carrying vehicles have their material handling implement mounted on the forward ends of a pair of lift arms which are pivotally connected to the vehicle body. However, this implement mounting arrangement has not been widely accepted for mounting a mast to a lift truck since the lift arms would swing the mast in an arc such that the forks move forwardly as they are raised, thereby reducing the load carrying capacity.

OBJECTS OF THE INVENTION

Accordingly, an object of this invention is to provide an improved lift truck mast positioning mechanism for mounting a mast in close proximity to the forward end of a lift truck.

Another object of this invention is to provide such an improved lift truck mast positioning mechanism which permits the overall height of the mast to be reduced without sacrifice to the maximum lift height capability.

Another object of this invention is to provide an improved lift truck mast positioning mechanism of the character described in which the forks are translated in a substantially straight path during raising and lowering thereof.

Other objects and advantages of the present invention will become more readily apparent upon reference to the accompanying drawings and following description.

DESCRIPTION OF THE PREFERRED EMBODIMENT

Figure 1:
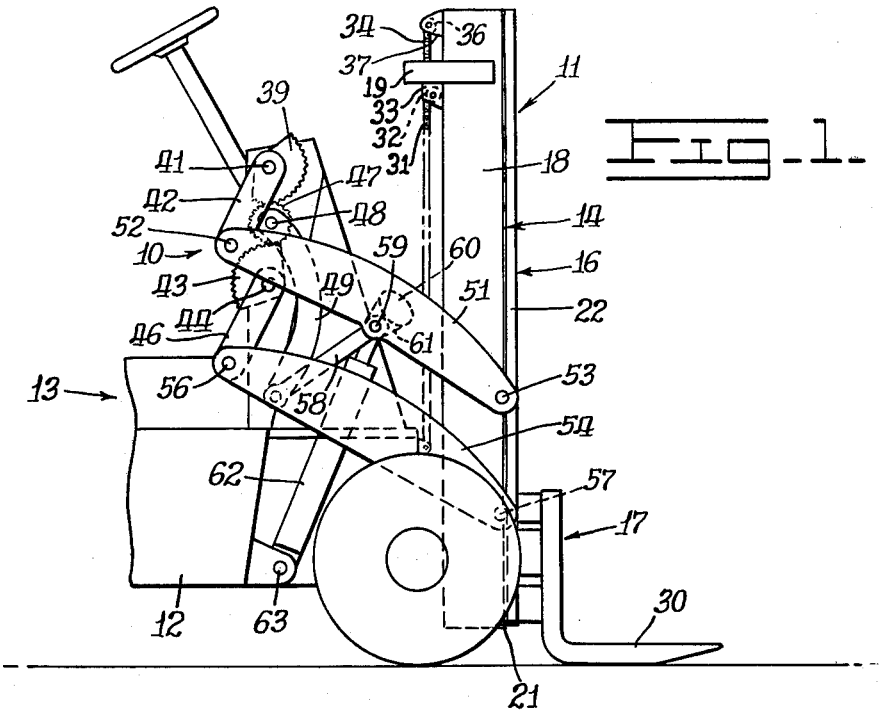
FIG. 1 is a side elevational view of a lift truck mast positioning mechanism embodying the principles of the present invention.

Referring to the drawings, a mast positioning mechanism embodying the principles of the present invention is generally indicated by the reference numeral 10 for mounting a mast 11 in front of a forward end of a longitudinally extending main frame 12 of a lift truck partially shown at 13. The mast includes an outer upwardly extending upright 14, an inner upwardly extending upright 16 mounted within the outer upright for telescopic movement therebetween, and a fork carriage 17 mounted on and movable along the inner upright.

Figure 4:
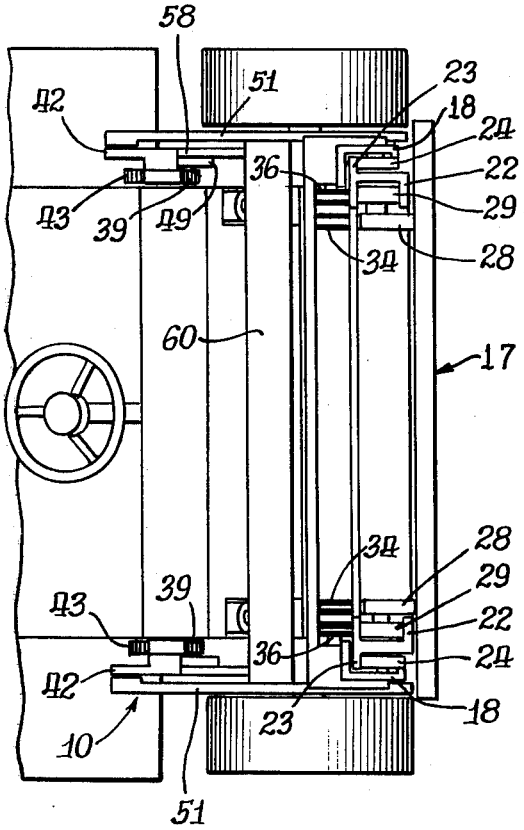
FIG. 4 is a top plan view of the lift truck mast positioning mechanism.

The outer upright 14 includes a pair of laterally spaced upwardly extending parallel outer channel members 18 which open towards each other as more clearly shown in FIG. 4. The channel members have their upper ends rigidly tied together by a U-shaped tie bar 19 and the lower ends rigidly tied together by a horizontally disposed cross plate 21.

The inner upright 16 has a pair of laterally spaced upwardly extending parallel inner channel members 22 which open inwardly toward each other. Each channel member has a generally J-shaped cross section with an inwardly extending flange 23 protruding into the respective outer channel member 18. A plurality of rollers, two of which are shown at 24 are individually rotatably mounted to the inner and outer channel members in the usual manner to provide for the telescopic movement between the inner and outer uprights. The inner channel members are rigidly interconnected at their rearward edges by a plurality of cross plates, not shown, in the usual manner with the cross plates positioned so as not to interfere with the telescopic movement between the inner and outer uprights and the movement of the fork carriage 17 relative to the inner upright.

The fork carriage 17 includes a pair of vertically extending plates 28 projecting rearwardly between the inner channel members 22. A plurality of rollers, two of which are shown at 29, are rotatably mounted to the vertical plates in the usual manner and are rollably arranged within the respective inner channel members. A pair of forks 30 are suitably mounted on the fork carriage for movement therewith.

A first pair of elongated flexible chains 31 are individually looped over a pair of chain rollers, one shown at 32, each of which is rotatably mounted to a supporting block 33 rigidly secured to the rearward edge of the respective outer channel member 18 below the tie bar 19. One end of each chain is anchored to the main frame 12 while the other end is attached to the lower portion of the respective inner channel member 22. A second pair of elongated flexible chains 34 are similarly individually looped over a pair of chain rollers 36, each chain roller being rotatably mounted to a rearwardly extending bracket 37 rigidly secured to the upper rearward edge of the inner channel members. One end of each flexible chain 34 is anchored to the tie bar 19 while its other end is attached to the respective vertical plate 28 of the fork carriage 17.

A mounting tower 38 is secured to and extends upwardly from the forward end of the main frame 12. An upper pair of sector gears 39 are disposed on opposite sides of the mounting tower and are rotatably mounted on a pair of pins, one shown at 41, secured to the upper portion of the mounting tower. Each of the sector gears has a crank arm 42 fixedly secured thereto. A lower pair of sector gears 43 are also disposed on opposite sides of the mounting tower in spaced relation below the upper sector gears and are rotatably mounted on a pair of pins, one shown at 44, secured to the mounting tower. Each of the lower sector gears has a crank arm 46 fixedly secured thereto. Each of a pair of gears 47 is rotatably mounted on a pin 48 secured to the respective side of the mounting tower with each gear disposed in meshing engagement with the respective upper and lower sector gears. Each gear has a crank arm 49 fixedly secured thereto.

A pair of longitudinally extending, laterally spaced lift arms 51 have their rearward ends disposed at opposite sides of the mounting tower 38 on the outboard sides of the crank arms 42 and are individually pivotally connected to the distal ends of the crank arms 42 by a pair of pivot pins, one shown at 52. The forward ends of the lift arms straddle the mast 11 and are pivotally connected to the outboard side of the outer channel members 18 by a pair of pivot pins, one shown at 53. A pair of longitudinally extending laterally spaced guide arms 54 are spaced below and substantially parallel to the lift arms and have their rearward ends disposed at opposite sides of the mounting tower on the outboard sides of the crank arms 46 and are individually, pivotally fastened to the crank arms 46 by a pair of pivot pins, one shown at 56. The forward ends of the guide arms straddle the mast and are pivotally connected to the outboard sides of the outer channel members by a pair of pivot pins, one shown at 57. Each of a pair of guide links 58 has one of its ends pivotally connected to the distal end of the crank arm 49 and its opposite end pivotally connected to the respective lift arm 51 intermediate the pivot pins 52 and 53 by a pivot pin 59. The lift arms are rigidly interconnected by a cross tube 60 which has a pair of laterally spaced brackets 61 extending downwardly therefrom adjacent the respective lift arms. Each of a pair of fluid actuated lift motors 62 are pivotally anchored to the main frame at a pivot 63 and have their rod ends pivotally connected to the lift arms and bracket 61 by the pivot pins 59.

The effective length of the lift arms 51 between the pivot pins 52 and 53 is equal to the effective length of the guide arms 54 between the pivot pins 56 and 57. Also, the linear distance between the pins 53 and 57 is equal to the linear distance between pins 52 and 56 forming a parallelogram type linkage which is effective to maintain the mast in the same position relative to a vertical plane throughout the total lifting sequence to be hereinafter described.

OPERATION

Figure 2:
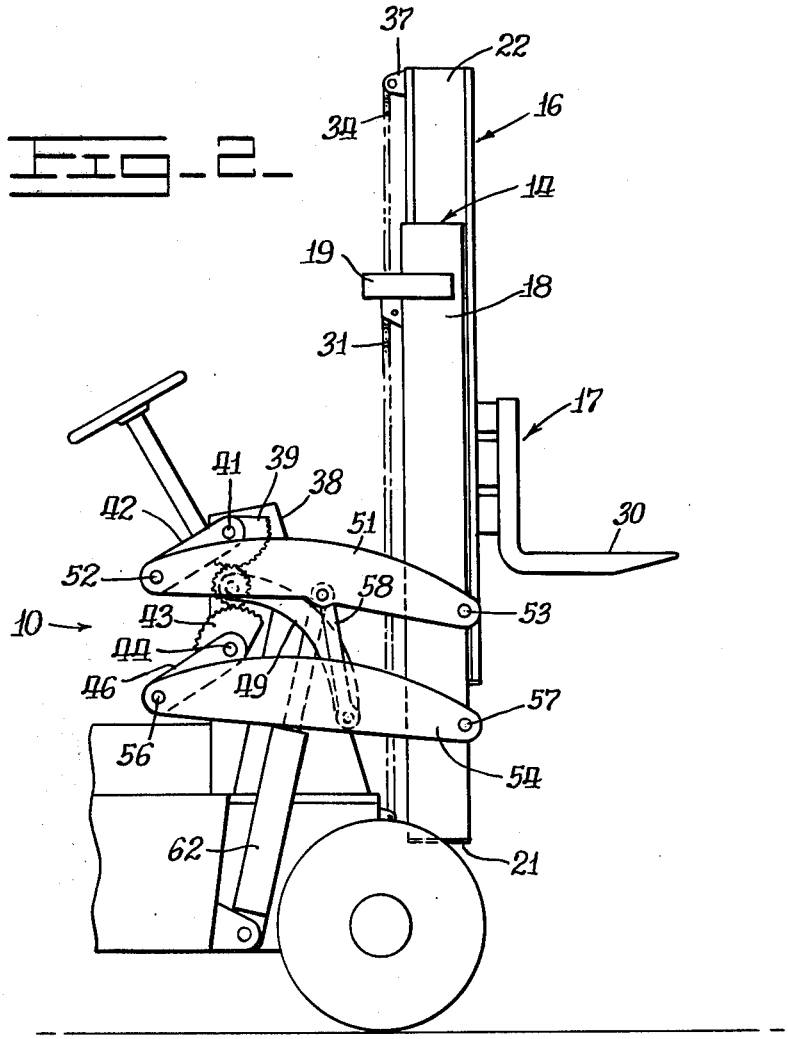
FIGS. 2 and 3 are side elevational views of the lift truck mast positioning mechanism of FIG. 1 with the forks elevated to intermediate and full lift positions, respectively.
Figure 3:
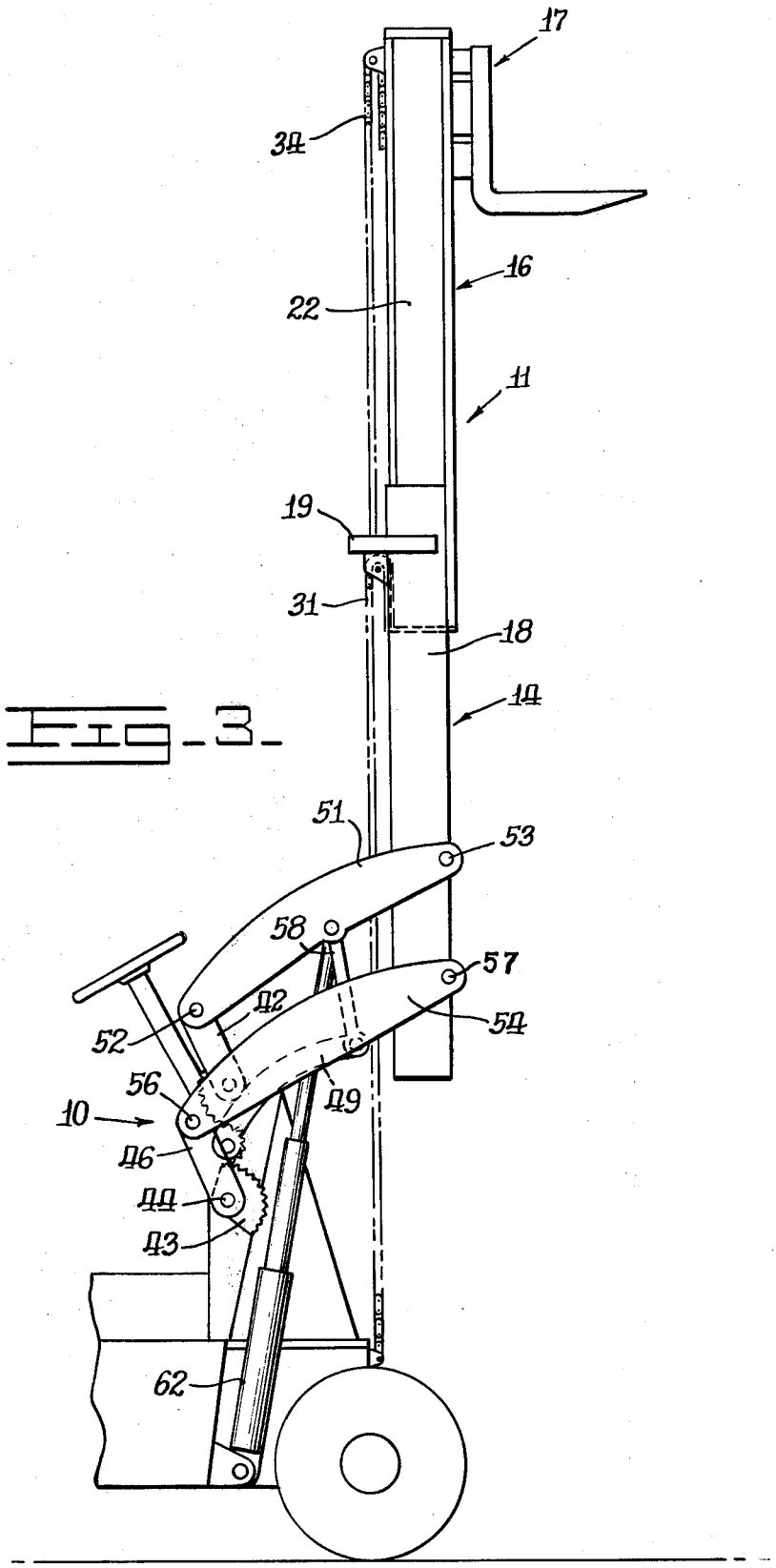

While the operation of the present invention is believed clearly apparent from the foregoing description, further amplification will subsequently be made in the following brief summary of such operation. With the lift motors 62 in their retracted condition, the mast positioning mechanism 10 is in the position shown in FIG. 1 wherein the lower end of the mast 11 is tucked in between the front wheels. Extending the hydraulic jacks causes the lift arms 51 to pivot about the pivot pins 52 and causes the mast to commense moving upwardly. By virtue of its pivotal connection to the mast, the guide arms 54 are forced to pivot about the pivot pins 56. Likewise, the pivotal movement of the lift arms about their pivot pins causes the guide links 58 to pull the distal ends of the crank arms 49 forwardly and upwardly thereby rotating the gears 47 counterclockwise about the pins 48 as viewed in FIGS. 1, 2 and 3. This causes the sector gears 39 and 43 and thus the crank arms 42 and 46 to be rotated clockwise about their pivot pins 41 and 44. As sequentially illustrated in FIGS. 1, 2 and 3, the length of the crank arms 42, 46 and 49 and the gear ratios between the gears 47 and the sector gears are chosen such that the pivot pins 52 and 56 are moved upwardly and rearwardly in arcuate paths during the lower half of the mast raising sequence to offset the tendency for the pins 53 and 57 to move in upwardly and forwardly in arcuate paths about pins 52 and 56. During the latter half of the mast raising sequence, the pins 52 and 56 move upwardly and forwardly in arcuate paths to offset the tendency for the pins 53 and 57 to move rearwardly in arcuate paths. The net result of the compound motion of the elements is that the mast moves in a substantially straight path upon extension and retraction of the lift motors.

The outer channel members 18 of the outer upright 14 are raised directly by extension of the lift motor 62 by virtue of their being pivotally connected to the forward ends of the lift arms 51. With the first flexible chains 31 being anchored to the main frame, the upward movement of the outer upright causes the first flexible chains to simultaneously pull the inner upright 16 upwardly relative to the outer upright a distance equal to the movement of the outer upright. Likewise, with the second flexible chains 34 being anchored to the outer upright, the upward movement of the inner upright causes the second flexible chain to pull the fork carriage 17 upwardly relative to the inner upright a distance equal to the movement of the inner upright. Thus, a triple mast effect is achieved with only a double mast section. Retracting the lift motors from their extend condition reverses the above operation and the fork carriage, inner upright and outer upright are returned to their lowered position.

Although the above mechanism is described in relation to positioning a mast of a fork lift truck, other load handling implements such as buckets, log forks, etc., may be mounted to the distal ends of the lift and guide arms so that the implement is raised and lowered in a substantially straight path.

In view of the foregoing, it is readily apparent that the structure of the present invention provides an improved mast positioning mechanism which permits the mast to be mounted in close proximity to the forward end of the lift truck and controls the position of the mast relative to the lift truck throughout its full range of lifting heights. This is achieved by mounting the mast to the forward end of the lift and guide arms while the rearward ends of the lift and guide arms are connected to the mounting tower through a floating pivot arrangement which moves the rearward ends of the lift and guide arms in arcuate paths to offset the tendency of the forward ends of the arms to follow an arcuate path as they pivot about the rearward pivots. Furthermore, by providing a triple mast effect with a double mast arrangement, the overall height of the mast is reduced without sacrificing the maximum lift height capability.

While the invention has been described and shown with particular reference to the preferred embodiment, it will be apparent that variations might be possible that would fall within the scope of the present invention, which is not intended to be limited except as defined in the following claims.

What is claimed is:

1. A mast positioning mechanism in combination with a lift truck of the type having a longitudinally extending main frame and a mounting tower secured to and extending upwardly from a forward end of the main frame, comprising:

an upwardly extending mast disposed adjacent the forward ends of the main frame;

means for pivotally connecting the mast to the mounting tower and for pivotally moving the mast between a lowered position and a raised position, said means including a pair of longitudinally extending, vertically spaced parallel arms having their forward ends pivotally connected to the mast, and a pair of sector gear means rotatably mounted on the mounting tower in spaced relation and individually pivotally connected to the rearward ends of the arms;

gear means rotatably mounted to the mounting tower in meshing engagement with both of the sector gear means and including a crank arm extending therefrom;

a guide link having one end pivotally connected to the distal end of the crank arm and its other end pivotally connected to one arm of the pair of arms.

2. The mast positioning mechanism of claim 1 wherein the gear means includes a gear fixedly secured to the crank arm, and each of the sector gear means includes a sector gear in meshing engagement with said gear.

3. The mast positioning mechanism of claim 2 wherein each of the sector gear means includes a crank arm fixedly secured to the respective sector gear and has its distal end pivotally connected to one of the pair of arms.

4. The mast positioning mechanism of claim 3 wherein both arms of the pair of arms have the same effective length.

5. The mast positioning mechanism of claim 4 wherein one of the pair of arms is an upper arm, the guide link being pivotally connected to the upper arm.

6. The mast positioning mechanism of claim 5 wherein the mast includes an upwardly extending upright pivotally mounted to the forward ends of the pair of arms, and a load lifting device operatively associated with the upright for upward movement relative thereto, and including means for raising the load lifting device relative to the upright automatically, simultaneously upon upward movement of the upright.

7. The mast positioning mechanism of claim 6 wherein the means for raising the load lifting device includes a roller rotatably attached to the upper end of the upright and an elongated flexible member looped over the roller and having one of its ends anchored to the main frame and its other end attached to the load lifting device.

8. The mast positioning mechanism of claim 7 wherein the load lifting device includes another upright operatively associated with said upright for telescopic movement relative thereto and a fork carriage mounted on and movable along the other upright, said other end of said flexible member being attached to the other upright.

9. The mast positioning mechanism of claim 8 including another roller rotatably attached to the upper end of the other upright, and another elongated flexible member looped over the other roller and having one of its ends anchored to the upright and its other end attached to the fork carriage.

10. The mast positioning mechanism of claim 1 wherein said means includes a hydraulic jack pivotally connected to said main frame and to one of said parallel arms for moving the mast between said lowered and raised positions.

11. An implement positioning mechanism in combination with a vehicle of the type having a longitudinally extending main frame and a mounting tower secured to and extending upwardly from a forward end of the main frame, comprising:

a load handling implement disposed adjacent the forward end of the main frame;

means for pivotally connecting the implement to the mounting tower and for moving the implement between a lowered position and a raised position, said means including a pair of longitudinally extending, vertically spaced parallel arms having their forward ends pivotally connected to the implement, and a pair of sector gear means rotatably mounted on the mounting tower in spaced relation and individually pivotally connected to the rearward ends of the arms;

gear means rotatably mounted to the mounting tower in meshing engagement with both of the sector gear means and including a crank arm extending therefrom;

a guide link having one end pivotally connected to the distal end of the crank arm and its other end pivotally connected to one arm of the pair of arms.

12. The mast positioning mechanism of claim 11 wherein said means includes a hydraulic jack pivotally connected to said main frame and to one of said parallel arms for moving the implement between said lowered and raised positions.

* * * * *